United States Patent [19]

Cortese

[11] Patent Number: 4,941,305

[45] Date of Patent: Jul. 17, 1990

[54] REPAIR OF EDGE DEFECTS IN BOARDS OF LUMBER OR THE LIKE

[76] Inventor: Thomas F. Cortese, 3333 Guido St., Oakland, Calif. 94602

[21] Appl. No.: 430,378

[22] Filed: Nov. 2, 1989

Related U.S. Application Data

[63] Continuation-in-part of Ser. No. 383,448, Jul. 24, 1989, Pat. No. 4,894,971.

[51] Int. Cl.[5] ..... E02D 37/00; E04G 23/00; B27G 1/00

[52] U.S. Cl. ..... 52/514; 29/402.13; 144/2 M; 144/332

[58] Field of Search ..... 228/119; 29/402.13; 52/514; 144/2 M, 330, 332

[56] References Cited

U.S. PATENT DOCUMENTS

| | | | |
|---|---|---|---|
| 276,499 | 0/1883 | Story | 52/514 |
| 1,976,722 | 10/1934 | Goss et al. | 20/91 |
| 2,217,311 | 10/1940 | Goss | 20/93 |
| 2,263,536 | 11/1941 | Dike | 144/332 |
| 2,536,665 | 1/1951 | Skoog | 156/94 |
| 3,487,530 | 1/1970 | Ely | 29/402.13 |
| 3,889,436 | 6/1975 | Elliott | 52/514 |
| 4,674,255 | 6/1987 | Derome | 52/514 |

FOREIGN PATENT DOCUMENTS

| | | | |
|---|---|---|---|
| 1921055 | 11/1970 | Fed. Rep. of Germany | 144/332 |
| 2517908 | 11/1976 | Fed. Rep. of Germany | 52/514 |

*Primary Examiner*—W. Donald Bray
*Attorney, Agent, or Firm*—Harris Zimmerman

[57] ABSTRACT

Boards of lumber or similar material having knotholes or other defects in an edge region are repaired by cutting an opening in the edge region to remove the defect and by filling the opening with a conforming plug formed of hardened mastic or of pieces of solid material which are adhered together. The opening extends inward from the edge of the board and is of greater extent at a location spaced inward from the edge than it is at another location that is closer to the edge. The expanse of the opening preferably increases at a first depth within the board and decreases at a second depth within the board. The configuration of the opening interlocks the conforming plug into the board thereby preventing ejection of the plug.

17 Claims, 2 Drawing Sheets

REPAIR OF EDGE DEFECTS IN BOARDS OF LUMBER OR THE LIKE

CROSS REFERENCE TO RELATED APPLICATION

This application is a continuation-in-part of applicants' copending U.S. patent application Ser. No. 383,448 filed July 24, 1989, now U.S. Pat. No. 4,894,971, and entitled "Board Repair for Correcting Defects in Lumber or the Like".

TECHNICAL FIELD

This invention relates to the repairing of defects in wooden boards or other similar materials and more particularly to repairs in which knots or other defects in boards are removed and replaced with filler material.

BACKGROUND OF THE INVENTION

Lumber boards produced in a sawmill or the like frequently exhibit knots, knotholes, pitch pockets, excavations made by birds or insects or other defects that detract from the quality of the board. Knots are acceptable or even desirable for some purposes but problems can still arise from the presence of loose knots, split knots or knotholes. Some types of defect can also occur in other structural materials such as fiberboard for example.

The quality of such boards or the like can be upgraded by cutting out the defective area and filling the resulting opening with a plug which may, for example, be a conforming piece of wood or hardened wood paste or mastic material. Such plugs have typically been held in place solely by adhesives and this can itself be a source of problems. Such plugs can be loosened and ejected from the board by impacts or other forces.

Prior efforts to inhibit dislodging of the plug have typically involved complicated operations such as the cutting of openings and forming of matching plugs that have convoluted shapes designed to resist twisting of the plug or to provide a greater area for application of adhesive. While such measures are effective to a degree, retention of the plug remains basically dependent on the adhesive bond.

Applicant's above identified copending U.S. patent application Ser. No. 383,448 discloses a board repair which can be easily performed and in which the plug is positively interlocked into the body of the board. Forces applied against either of the opposing faces of the board cannot dislodge the plug.

Defects of the type which should be repaired can occur along the edges of the board in which case the plug can be susceptible to ejection by forces acting in a direction that is parallel to the plane of the board or the like. It would be advantageous, in the case of repairs to defects at the edges of the board, if the plug inherently resisted ejection by such forces in addition to resisting dislodging by forces acting in directions normal to the plane of the board.

The present invention is directed to overcoming one or more of the problems discussed above.

SUMMARY OF THE INVENTION

In one aspect, this invention provides a repaired board of lumber or similar material having an opening in the original material of the board that extends to an edge surface of the board and at which a defect in the edge region of the board has been removed in the course of cutting the opening. A conforming plug of filler material fills the opening. A first region of the opening extends along the board for a greater distance than a second region of the opening that is situated closer to the edge surface of the board.

In another aspect of the invention, the dimension of the opening and the plug, taken in a direction parallel to the plane of the board, undergoes a change at a first depth within the board and undergoes a reversed change at a second depth within the board.

In another aspect, the invention provides a repaired board of lumber or similar material of the type having oppositely facing flat, parallel, major surfaces and having an edge surface which extends between the major surfaces. An opening in the original material of the board extends between the major surfaces and also to the edge surface at a location where a defect in the edge region of the board has been removed in the course of cutting the opening. A first region of the opening extends along the board and a second region of the opening extends along the board for a greater distance at a location that is inward from the edge surface and the first region. The expanse of the opening, taken in a plane parallel to the major surfaces of the board, changes at a first location between the major surfaces and changes in a reversed manner at another location between the major surfaces. A plug of solid filler material is disposed in the opening and has a configuration conforming to the configuration of the opening.

In still another aspect, the invention provides a method of repairing a defect in an edge region of a board of lumber or like material. Steps in the method include cutting an opening in the edge region of the board to remove the defect including forming the opening to extend inward from the edge surface of the board and to have a region located inward from the edge surface that extends along the board a greater distance than another region of the opening that is closer to the edge surface. A plug is disposed in the opening and is formed with a configuration that conforms to the configuration of the opening.

In another aspect of the method, the opening is formed to extend between the opposite parallel major surfaces of the board as well as to the edge surface and is formed to have an expanse which increases at a first location between the major surfaces and which decreases at a second location between the major surfaces.

The invention provides for repair of knots, knotholes or other defects along the edges of a board or the like with a plug that is inherently interlocked into the original material of the board. The plug cannot be withdrawn outwardly from the edge of the board and, in the preferred form, cannot be dislodged by pressure against the major surfaces of the board. The plug may be bonded to the original material of the board by adhesive but retention of the plug is not wholly dependent on the strength or stability of the bond to the original material. The invention enables rapid, efficient and economical upgrading of defective lumber or the like.

The invention may be further understood by reference to the following description of preferred embodiments and by reference to the accompanying drawings.

DETAILED DESCRIPTION OF THE PREFERRED EMBODIMENTS

Figure 1:
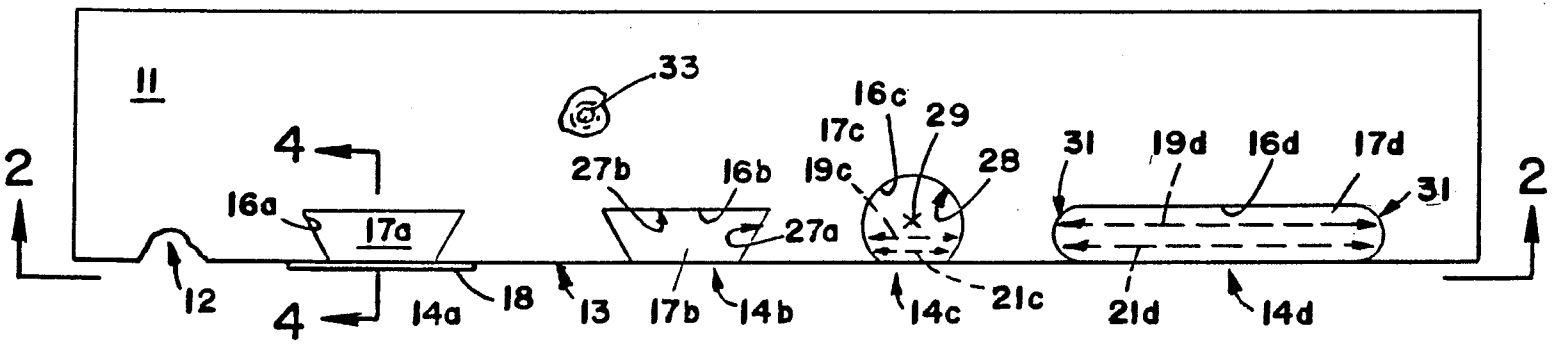
FIG. 1 is a plan view of a board of lumber having a series of defect repairs along one edge in accordance with preferred embodiments of the invention.
Figure 2:
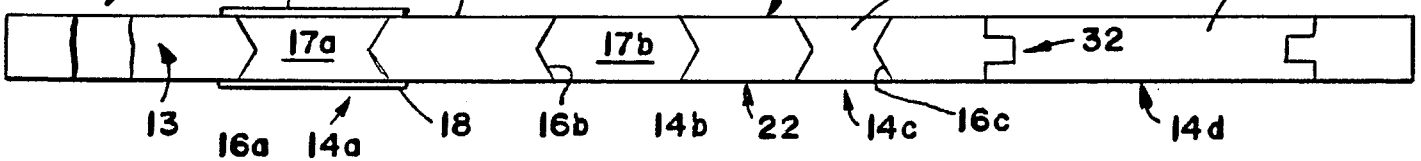
FIG. 2 is a view of the repaired edge of the board taken along line 2—2 of FIG. 1.

Referring jointly to FIGS. 1 and 2 of the drawing, a board 11 of lumber or the like may exhibit one or more defects 12 along one or more edge surfaces 13 that adversely affect the quality of the board. The defect 13 is a knothole in this example but may variously be a knot itself, a loosened or split knot, apertures made by insects or birds, impact damage or any of a number of other localized disruptions of the board material. FIGS. 1 and 2 depict a series of repairs 14*a*, 14*b*, 14*c*, and 14*d* of similar defects along the edge region of board 11 each of which has a different configuration in order to illustrate a number of different embodiments of the invention. In actual practice, it may be more convenient to form each of the repairs 14 on a given board 11 or series of boards with the same general configuration although this is not an essential requirement.

Edge defect repair 14*a* in particular is formed by cutting an opening 16*a* in the edge region of board 12 at the location of an edge defect in order to remove the defect and then filling the opening with a plug 17*a* having a configuration that conforms with the configuration of the opening. The plug 17*a* in this particular example is a body of hardenable wood paste but other materials may also be employed, an example of which will hereinafter be described. Where the plug 17*a* material is initially soft and pliable as in the case of wood paste, strips of adhesive coated tape 18 may be adhered to the exterior surfaces of board 11 in the region of opening 16*a* to assure that the plug surfaces are flat and coplanar with the board surfaces. Tapes 18 are removed after the plug 17*a* material has hardened.

Figure 3:
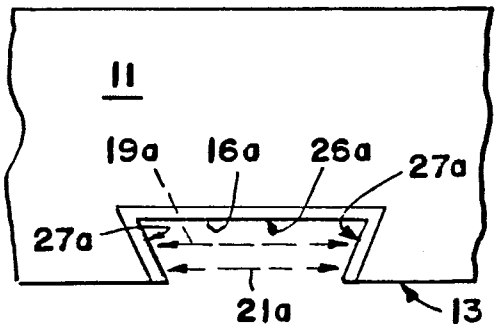
FIG. 3 is a plan view of a portion of the board depicting an initial step in the fabrication of a board repair embodying the invention.
Figure 4:
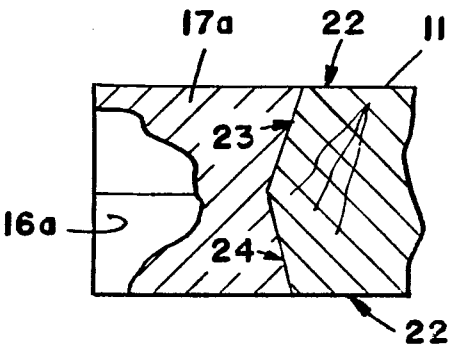
FIG. 4 is a partial cross section view of the board of FIG. 1 taken along line 4—4 thereof with portions of the structure being broken out.

Referring to FIGS. 3 and 4, the opening 16*a* is formed with a configuration which results in an interlocking of the plug 17*a* with the adjacent material of board 11 that prevents the plug from being ejected from the opening by forces which may be applied to the plug. A variety of opening configurations are suitable for this purpose, further examples of which will be hereinafter described, but such configurations are in general ones in which a first region 19*a* of the opening extends along the board 11 for a greater distance than another region 21*a* of the opening that is located closer to edge surface 13 of the board. This blocks dislodging of the plug 17*a* through board edge surface 13 by forces having a component acting in a direction parallel to the plane of the board.

In most cases it is also desirable to block ejection of the plug 17*a* out of opening 16*a* by forces acting in a direction normal to the plane of board 11. Again, a variety of opening configurations can effect this result but such configurations are in general ones in which the expanse or thickness of the plug 17*a*, taken in a plane parallel to the major surfaces 22 of the board 11, undergoes a change at a first depth 23 within the board and undergoes a reversed change at a second depth 24 within the board.

In the present specific example, these objectives are met by making a linear cut 26*a* along board 11 at a location spaced inward from the board edge surface 13. The opening 16*a* is further defined by a pair of additional linear cuts 27*a* each of which extends from a separate end of cut 26*a* to board end surface 13, the cuts 26*a* being acutely angled relative to cut 26*a* and thus being somewhat convergent in the direction of edge surface 13. To prevent plug 17*a* ejection at right angles to the plane of board 11, the angled cuts 27*a* are doubly beveled in a manner which causes the opening 16*a* to be of less expanse at the mid-plane of the board 11 than at the major surfaces 22 of the board as may best be seen in FIG. 2. This form of beveling may be reversed, if desired, as in the case of edge repair 14*b* which is otherwise similar to repair 14*a*. In particular, the opening 16*b* of repair 14*b* is of maximum expanse at the mid-plane of board 11 and of minimum expanse at each of the major surfaces 22 of the board. It should also be recognized that varying the expanse of the openings 16 at a first depth within board 11 and reversely varying the expanse at a different depth does not necessarily require beveling and resultant angling of the profiles of the openings. A similar result is achieved if the cuts 27*a* or 27*b* have a curved profile which may be either convex or concave.

Referring again to FIGS. 3 and 4, the cut 26*a* which defines the boundary of opening 16*a* that is parallel to board edge surface 13 also has the doubly beveled profile described above with regard to cuts 27*a*. This is not strictly necessarily in order to block dislodgement of plug 17*a* but can be advantageous as it strengthens the interlocking of the plug and board 11 and prevents flexing of the plug and board relative to each other.

The wood paste or other mastic material which forms plug 17*a* bonds to the adjoining wood of board 11 as it cures but the repair 14*a* is not dependent on the strength or stability of the bond for the purpose of preventing dislodging of the plug. The above described configuration of the opening 16*a* and the conforming plug 17*a* inherently prevents ejection of the plug from the opening.

Referring again to FIGS. 1 and 2, the edge repairs 14 need not necessarily have the trapezoidal configuration described above with regard to repairs 14*a* and 14*b* in particular. Repair 14*c*, for example, is formed by making a circular cut or bore 28 into board 11 at the location of a defect with the center of curvature 29 of the circular cut being located on the board and being spaced from board edge surface 13 by a distance smaller than the radius of the circle. This again results in an opening 16*c* and thus a plug 17*c* which has a first region 19*c* which extends along the board for a greater distance than a second region 21*c* of the opening that is closer to board edge surface 13. The circular opening 16*c* is of greater diameter at the planes of the surfaces 22 of the board 11 than it is at the mid-plane of the board thereby preventing dislodging of the plug through such surfaces. This opening configuration can be easily formed with the use of a tapered countersink drill by drilling into the board through both surfaces 22.

The oblong edge repair 14d of FIGS. 1 and 2 is particularly suited for correcting a relatively lengthy defect in the edge region of board 11. An elongate opening 16d is cut into the edge region of the board 11 at the location of the defect and is filled with hardenable plug 17d material as in the prior described embodiments of the invention. The ends 31 of opening 16d have a semicircular configuration again providing for a first region 19d of the opening that extends along the board 11 for a greater distance than another region 21d of the opening that is closer to board edge surface 13. Interlocking of plug 17d against dislodgement at right angles to the plane of board 11 is provided for, in this case, by forming the opening 16d to be of reduced expanse at the region 32 of the board that is midway between the outer surfaces 22 of the board. This results in a tongue and groove type of interlocking of the plug 17d and adjacent wood.

Defects 33 in board 11 which are away from the edge regions of the board can be repaired in the manner described in the hereinbefore identified copending application Ser. No. 383,448.

Figure 5:
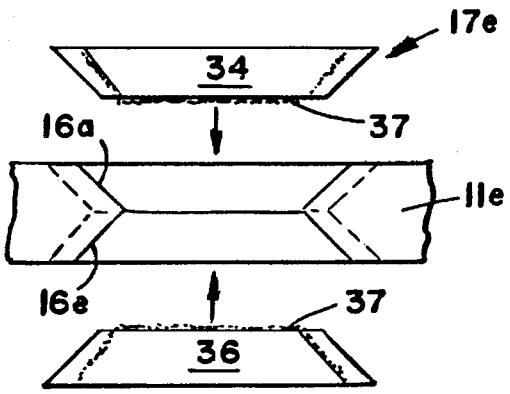
FIG. 5 is an edge view of a portion of a board and components used for repairing an edge defect in accordance with another embodiment of the invention.

The embodiments of the invention described above each make use of a plug 17 formed by filling the opening 16 with a semiliquid material which is then cured or hardened. Referring to FIG. 5, the plug 17e can also be formed from solid material such as wood similar to that of the board 11e in which it is to be placed. Because of the interlocking relationship of the plug 17e and board 11e, this requires that two or more portions 34 and 36 of the plug be initially formed as separate elements and be entered into the opening 16e from different directions. The number of components 34, 36 and the configuration of such components prior to assembly of the plug 17e is dependent on the shape of the opening 16e, two such components being required in the specific example depicted in FIG. 5.

The opening 16e of the board edge repair 14e shown in FIG. 5 is identical to the opening 16a of board repair 14a as previously described with reference to FIGS. 1 to 4. Returning to FIG. 5, a conforming plug 17e can be pre-fabricated of wood or other solid material by forming two identical plug components 34 and 36 each having a configuration similar to that of the region of opening 16e that lies between the mid-plane of board 11e and one of the major surfaces 22 of the board. The surfaces of the components 34 and 36 which are to be abutted to form the assembled plug are coated with an adhesive 37 and the two components are then seated in the opening 16e through opposite sides of the board 11e. Curing of the adhesive 37 unitizes the components 34 and 36 to form the assembled plug and to interlock the plug into the board 11e.

Figure 6:
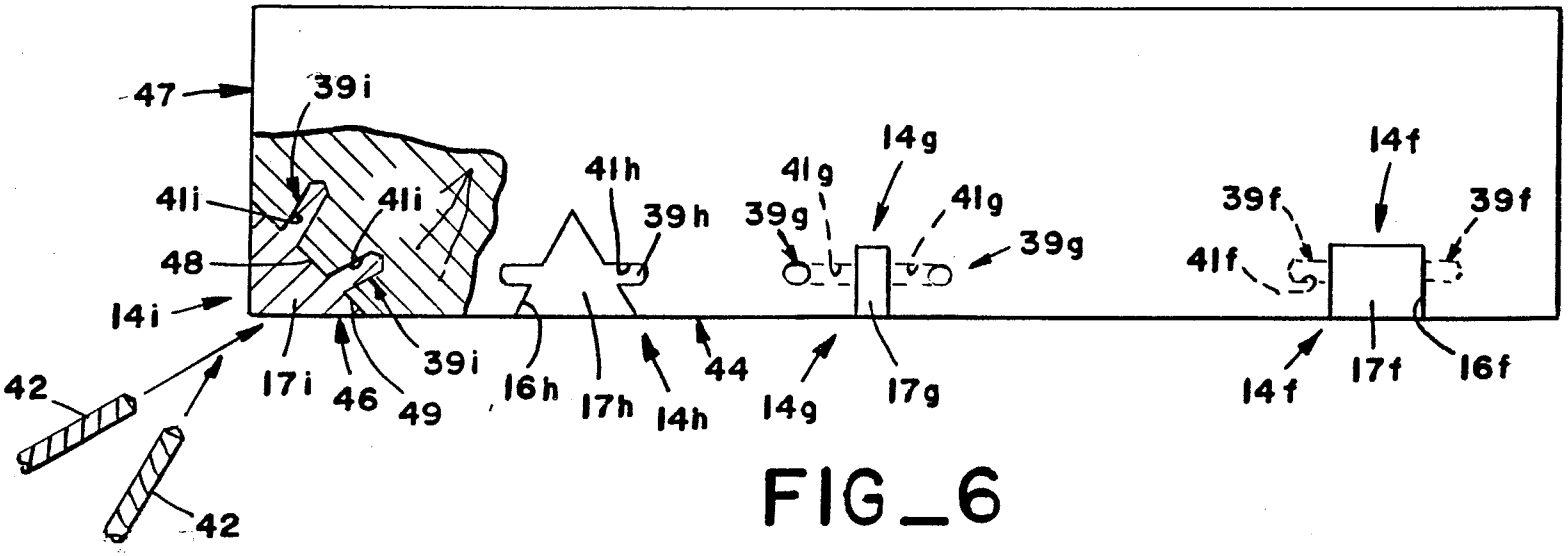
FIG. 6 is a partially broken out plan view of another lumber board having a series of edge defect repairs in accordance with other examples of the invention.
Figure 7:
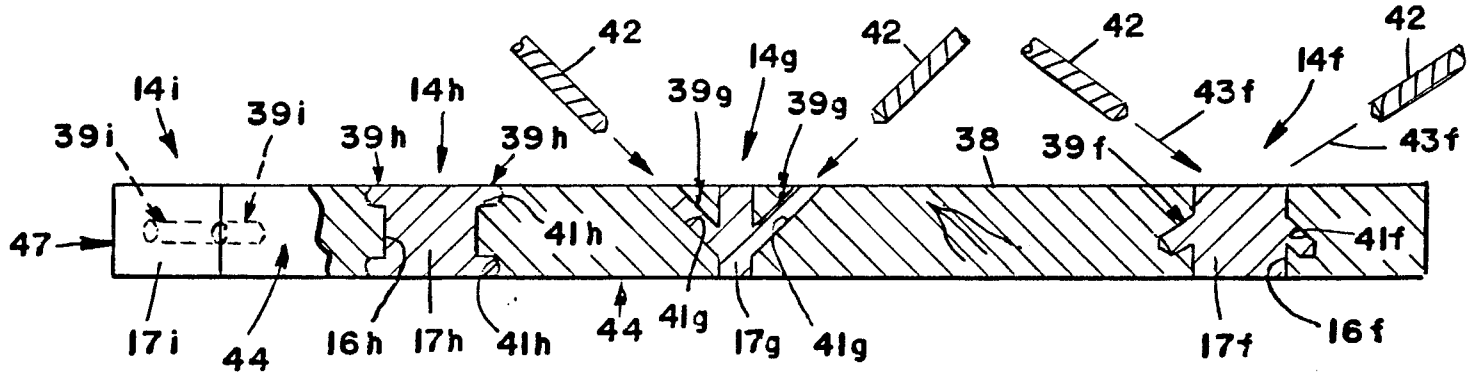
FIG. 7 is a partially broken out elevation view of the board of FIG. 6 depicting the repaired edge of the board.

FIGS. 6 and 7 depict another lumber board 38 having a series of edge defect repairs 14f, 14g, 14h and 14i in which the plugs 17f, 17g, 17h and 17i are interlocked into the board by projections 39f, 39g, 39h and 39i respectively. The projections 39f, 39g, 39h and 39i are integral with the plugs 17f, 17g, 17h and 17i respectively and extend into conforming bores 41f, 41g and 41i or conforming notches 41h in the case of repair 14h in particular, that are formed within board 38. Bores 41f, 41g, 41i and notches 41h respectively communicate with and form a part of the openings 16f, 16g, 16i and 16h that are cut into the edge of the board 38 for the purpose of eliminating edge defects.

The opening 16f that is cut into an edge of board 38 to remove an edge defect at repair 14f in particular has a basically rectangular shape, although other configurations are also suitable, except insofar as a bore 41f extends a short distance from the rectangular region of the opening into the adjacent wood at each side of the opening. Thus filling of the opening 16f with hardenable filler material results in a plug 17f which is interlocked into the board 38 by short projections 39f on the otherwise rectangular plug. A single bore 41f and plug projection 39f can provide the desired interlocking in some cases but the use of two or more strengthens the securing of the plug 17f to the board 38.

Bores 41f can be drilled before or after the rectangular region of opening 16f has been cut by advancing a drill bit 42 into board 38 along paths 43f which form an acute angle with the plane of the board and which enters the board in the region of the opening 16f. Alternately, as depicted at edge repair 14g, the inclined drill bit 42 can be traveled into board 38 along paths 43g which enter the board at locations spaced apart the rectangular region of the opening 16g but which intersect that region. Upon filling of the opening 16g with hardenable material, a plug 17g is produced that has projections 39g that extend to the surface of the board 38.

The openings 16, plugs 17 and projections 39 can have a variety of other configurations provided that one portion of the opening and plug extends along the board for a greater distance than another portion that is closer to the board edge 44. Repair 14h, for example is of generally triangular shape except insofar as a pair of notches 41h are cut into each of the major surfaces 32 of board 38. The two notches 41h at each of the board surfaces 32 extend a small distance outward from opposite sides of the triangular region of opening 16h. Upon filling of opening 16h, including notches 41h, with hardenable material, the resulting plug 17h has tab-like projections 39h that interlock the plug into the board 38.

Edge repairs of the herein described types can also be made at a corner 46 of a board 38, edge repair 14i being an example. This requires that the conditions for interlocking the plug 17i into the board 38 be met with respect to both of two intersecting edges 44 and 47 of the board. In the present example, a defective corner region of the board 38 is cut away along a diagonal line 48 that intersects both edges 44 and 47 and a pair of spaced apart bores 41i are drilled into the resulting diagonal edge 49 at the board corner 46. The bores 41i are angled with respect to each other and are divergent in the present example although convergent bores are also suitable. The bores 41i are then filled with hardenable filler material and additional filler material is applied and cured to form a plug 17i having a configuration conforming to that of the original wood that was removed from the corner 46 region of the board 38.

While the invention has been described with respect to certain specific embodiments for purposes of example, many modifications and variations are possible and it is not intended to limit the invention except as defined in the following claims.

I claim:

1. A repaired board of lumber or similar material having opposite parallel major surfaces and an edge surface which extends therebetween, said board having an opening in the original material of the board that extends to said edge surface and at which a defect in the edge region of the board has been removed in the course of cutting the opening in the board, said board further having a conforming plug of filler material filling said opening, and wherein a first region of said opening extends along said board for a greater distance than a second region of the opening that is situated closer to said edge surface of said board than said first region.

2. The repaired board of claim 1 wherein the dimension of said opening and said plug, taken in a direction parallel to said major surfaces of said board, undergoes a change at a first depth within said board undergoes a reversed change at a second depth within said board.

3. The repaired board of claim 1 wherein said second region of said opening is adjacent said edge surface of said board.

4. The repaired board of claim 1 wherein said opening and said plug have a trapezoidal configuration with convergent opposite ends that extend to said edge surface of said board.

5. The repaired board of claim 1 wherein said opening and said plug have a circular periphery except at said edge surface of said board, the periphery of said opening and plug at the plane of said edge surface being linear and being coincident with said edge surface, the center of curvature of the circular periphery of said opening and plug being spaced inwardly from said edge surface of said board by a distance which is smaller than the radius of curvature of said circular periphery.

6. The repaired board of claim 1 wherein said opening and said plug have an oblong configuration with circular end regions at spaced apart locations along said board, the centers of curvature of said circular end regions being spaced inwardly from said edge region of said board.

7. The repaired board of claim 1 wherein said opening has a first region extending inward from said edge surface of said board and is further defined by at least one bore which extends from said first region into an adjacent portion of said board, and wherein said plug has a projection extending into said bore, said bore and plug projection being oriented to block withdrawal of said plug from said board.

8. The repaired board of claim 7 wherein said bore and plug projection are angled relative to said major surfaces of said board.

9. The repaired board of claim 8 wherein said bore and plug projection extend from said first region of said opening to one of said major surfaces of said board and intersect said one of said major surfaces at a location spaced apart from the intersection of said first region of said opening therewith.

10. The repaired board of claim 1 wherein said opening in the original material of said board has a first region which extends inward from said edge surface of said board and further includes at least one notch cut into each of said major surfaces of said board which notches communicate with said first region of said opening and wherein said conforming plug has projections which extend into said notches.

11. The repaired board of claim 1 wherein said opening and conforming plug are at a corner region of said board where said edge surface of said board intersects with an end surface thereof, and wherein said opening has a third region that extends along said end surface for a greater distance than a fourth region of the opening that is situated closer to said end surface than said third region.

12. The repaired board of claim 1 wherein said plug is comprised of mastic material which has been hardened within said opening.

13. The repaired board of claim 1 wherein said plug is comprised of pieces of solid material adhered together with adhesive.

14. A repaired board of lumber or similar material having oppositely facing flat, parallel, major surfaces and an edge surface which extends between said major surfaces along an edge of the board, said board having an opening in the original material thereof which opening extends between said major surfaces of said board and extends to said edge surface and from which a defect in the edge region of said board has been removed in the course of cutting said opening, wherein a first region of said opening extends along said board and a second region of said opening extends for a greater distance along said board at a location that is inward from said edge surface and said first region, and wherein the expanse of said opening, taken in a plane parallel to said major surfaces of said board, changes at a first location between said major surfaces and changes in a reversed manner at another spaced apart location between said major surfaces, and wherein said board further has a plug of solid filler material disposed in said opening, said plug having a configuration which conforms to the configuration of said opening.

15. The repaired board of claim 14 wherein said opening has symmetical end regions at spaced apart locations along said board that intersect said edge surface of said board and which are convergent at least at the edge region of said board.

16. In a method of repairing a defect in an edge region of a board of lumber or like material, said board having flat, parallel opposite major surfaces and an edge surface which extends between said major surfaces, the steps comprising;

cutting an opening in said edge region of said board at the location of said defect to remove said defect therefrom including forming said opening to extend inward from said edge surface of said board and to have a region located inward from said edge surface that extends along said board a greater distance than another region of the opening that is closer to said edge surface, and disposing a plug in said opening having a configuration which conforms with the configuration of said opening.

17. The method of claim 16 including the further steps of forming said opening to extend between said major surfaces of said board, and forming said opening to have an expanse which increases at a first location between said major surfaces of said board and which decreases at a second location between said major surfaces of said board.

* * * * *